United States Patent [19]

Rochelle et al.

[11] 3,997,639

[45] Dec. 14, 1976

[54] METHOD FOR WEIGHT COATING PIPE SEGMENTS

[75] Inventors: William R. Rochelle; Leroy N. Larenzo; Eberhard V. Ranft, all of Houston, Tex.

[73] Assignee: Brown & Root, Inc., Houston, Tex.

[22] Filed: June 30, 1975

[21] Appl. No.: 591,653

Related U.S. Application Data

[63] Continuation of Ser. No. 378,045, July 11, 1973, abandoned.

[52] U.S. Cl. ..... 264/39; 264/135; 264/265; 264/271; 264/275; 264/333

[51] Int. Cl.[2] ..... B28B 11/12

[58] Field of Search ..... 104/48, 50; 425/88, 425/126, 127; 264/57, 58, 271, 275, 333, 256, 265, 39, 135; 214/38 BB

[56] References Cited

UNITED STATES PATENTS

| | | | |
|---|---|---|---|
| 175,709 | 4/1876 | Irby | 104/48 |
| 1,941,299 | 12/1933 | Greenidge | 425/127 |
| 2,909,825 | 10/1959 | Cummings | 425/126 |
| 3,739,050 | 6/1973 | Koncz | 425/88 X |

FOREIGN PATENTS OR APPLICATIONS

| | | | |
|---|---|---|---|
| 1,093,066 | 11/1960 | Germany | 104/48 |

*Primary Examiner*—Robert F. White
*Assistant Examiner*—Thomas P. Pavelko

[57] ABSTRACT

The method includes the steps of cleaning, priming, and coating pipe segments with a bituminous composition. The coated pipe segments are wrapped and carefully handled so as not to disturb the bituminous coating. Wire reinforcing cages are formed around the pipe segments and the individual pipe segments are then loaded into individual mold cars positioned end-to-end upon a first railway track assembly. The cars are then translated onto a first transfer car, which rides on a second track means, and are conveyed to a third railway track assembly comprising a plurality of parallel sets of rails. The mold cars are transferred abreast from the transfer car onto the third railway track assembly, filled with a cementitious weight coating material and fed into a drying kiln whereby the cementitious weight coating cures at least until the cement becomes self-supporting. The cars are then translated abreast onto a second transfer car, riding upon a fourth track assembly, positioned at the other end of the third railway means. The molds are opened and the weight coated pipe segments are removed. The empty mold cars are then transferred to the other end of the first railway track assembly where the individual mold cars are sequentially aligned with the other end of the first railway track means and translated onto the first track means in an end-to-end relationship, thus closing the handling loop.

1 Claim, 10 Drawing Figures

METHOD FOR WEIGHT COATING PIPE SEGMENTS

This is a continuation of application Ser. No. 378,045, filed July 11, 1973, now abandoned.

BACKGROUND OF THE INVENTION

This invention relates to a method and apparatus for weight coating pipe segments. More specifically, the invention relates to a method and apparatus for preparing steel pipe segments to be weight coated and for handling railway mold cars operable to form a cementitious weight coating upon the exterior surface of the pipe segments. Steel pipe segments of this type are typically designed to be connected end-to-end into a pipeline to be laid upon the bed of a body of water.

With the discovery of sizable oil and natural gas deposits offshore and the subsequent successful drilling and production thereof, a problem arose in connection with the most economical means for transporting the crude petroleum and/or natural gas from the producing offshore site to a shore location or collection/transfer terminal.

Often the most economical means for transporting oil and gas between offshore locations has been to establish submerged pipelines extending between the producing and collecting stations. In this connection U.S. Pat. No. 3,280,571; Lawrence U.S. Pat. Nos. 3,390,532; 3,472,034; and 3,487,648; Rochelle et al reissue U.S. Pat. No. Re.27,420; Smith U.S. Pat. No. 3,566,609; Lochridge U.S. Pat. No. 3,606,759; Nolan U.S. Pat. No. 3,645,105 and Jones et al U.S. Pat. No. 3,667,878, all assigned to the assignee of the subject invention, disclose highly effective methods and apparatus for laying a pipeline upon the bed of a body of water.

Although, as previously noted, the pipelines are fabricated from steel conduits, the lines typically displace more water than the weight of the pipe and the oil and/or natural gas to be carried by the line. As a consequence, offshore oil pipelines have a tendency to float within the body of water.

In order to eliminate this buoyant tendency, it has been industry wide practice to coat the exterior of the pipeline with a heavy cementitious weight coating of a thickness suitable to raise the specific gravity of the pipeline per linear foot to a desired preselected degree such as, for example, 1.3.

While various techniques have been at least theorized for applying a weight coating to the exterior surface of pipe segments, the most common practice entails impacting techniques. Such techniques, however, leave room for significant improvement, particularly in terms of weight coating surface finish, concentricity, evenness of depth, etc., as more fully discussed in applicants' previously noted related application which discloses and claims mold assemblies for weight coating pipe segments.

In dealing with large and weighty mold assemblies, of the type discussed in applicants' copending application, it would be desirable to optimize management of the molds and provide a compact, rugged and reliable handling arrangement. In achieving such optimization, such factors as preparing the pipe segments to be weight coated, various stages of the actual weight coating operation, etc. each of which may consume variant time frames, must be considered and advantageously harmonized.

OBJECTS AND SUMMARY OF THE INVENTION

Objects:

It is therefore an object of the invention to provide a novel method for molding a cementitious weight coating onto the exterior surface of a plurality of pipe segments wherein individual steps are mechanised, correlated and arranged in a highly efficient and judicious manner with respect to space utilization and functional systems requirements.

It is a particular object of the invention to provide a novel method and apparatus for handling railway mold cars operable to form a weight coating of cementitious material upon the exterior of pipe segments which is suitable to accommodate and reliably handle extremely large and heavy railway form assemblies.

It is another object of the invention to provide a novel method and apparatus for handling railway mold cars operable to form a cementitious weight coating upon the exterior surfaces of pipe segments, wherein efficient handling and management of the mold cars is optimized.

It is yet another object of the invention to provide a novel method and apparatus for handling railway mold cars operable to form a cementitious weight coating upon the exterior surface of pipe segments wherein the mold cars may be continuously handled in a closed loop system with functions of necessarily variant time intervals advantageously accommodated.

It is a further object of the invention to provide a novel method and apparatus for handling and preparing pipe segments to be weight coated prior to the actual application of a weight coating composition to the pipe segments.

It is still a further object of the invention to provide a novel method and apparatus for translating weighty mold car assemblies upon a compact closed loop railway track system.

It is a specific object of the invention to provide a novel method and apparatus for advantageously handling weight coating mold cars continuously in a closed loop while marrying relatively rapidly performed operations such as applying a wire reinforcing cage to pipe segments with relatively slowly performed operations such as drying the weight coating composition.

Brief Summary:

A method and apparatus, according to a preferred embodiment of the invention, intended to accomplish at least some of the foregoing objects comprises a closed loop railway handling system including a first single railway track for supporting mold cars aligned end-to-end for receiving pipe segments to be weight coated. Power means are provided to translate the mold cars to one end of the unitary railway track and selectively load a plurality of the cars onto a first transfer car assembly. The first transfer car rides upon a second railway track system in a direction normal to the first railway track assembly. The plurality of mold cars are transferred to and then guided onto a third railway track means comprising a plurality of parallel railway rails. The molds receive a weight coating composition and are fed into a longitudinally extended drying kiln to partially cure. Following curing of the weight coating to the point of being self-supporting, the cars are transferred abreast onto a second transfer car means. The second transfer car is mounted upon a fourth railway track system extending generally normal to the first and third railway track assemblies. The mold cars are then transferred to the other end of the unitary track and again aligned thereupon in end-to-end relationship.

The method includes the steps of cleaning, priming, and coating pipe segments with a bituminous composition. The coated pipe segments are wrapped and carefully handled so as not to disturb the bituminous coating. Wire reinforcing cages are formed around the pipe segments and the individual pipe segments are then loaded into individual mold cars positioned end-to-end upon a first railway track assembly. The cars are then translated onto a first transfer car, which rides on a second track means, and are conveyed to a third railway track assembly comprising a plurality of parallel sets of rails. The mold cars are transferred abreast from the transfer car onto the third railway track assembly, filled with a cementitious weight coating material and fed into a curing kiln whereby the cementitious weight coating cures at least until the cement becomes self-supporting. The cars are then translated abreast onto a second transfer car, riding upon a fourth track assembly, positioned at the other end of the third railway means. The molds are opened and the weight coated pipe segments are removed. The empty mold cars are then transferred to the other end of the first railway track assembly where the individual mold cars are sequentially aligned with the other end of the first railway track means and translated onto the first track means in an end-to-end relationship, thus closing the handling loop. THE DRAWINGS Other objects and advantages of the present invention will become apparent from the following detailed description of the preferred embodiments thereof taken in conjunction with the accompanying drawings wherein:

Figure 5:
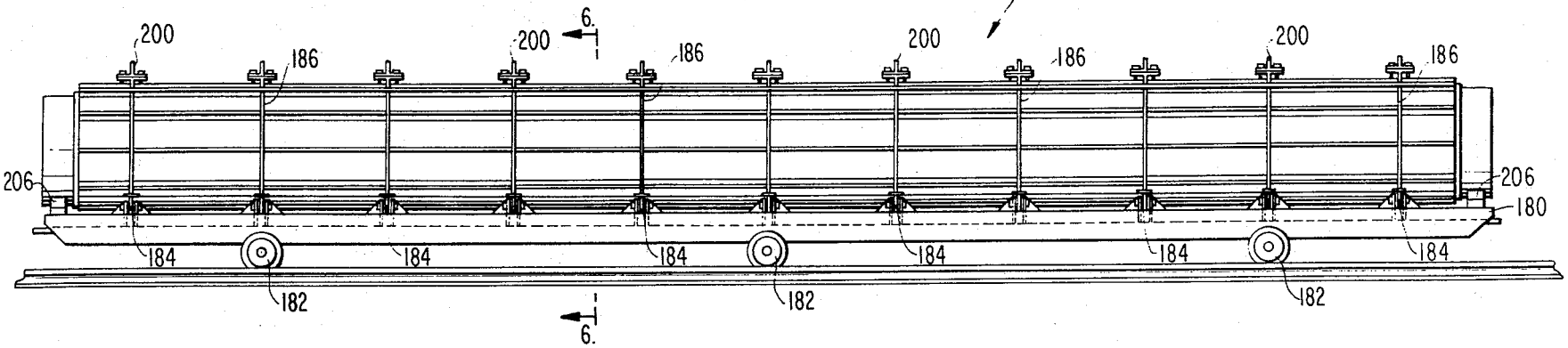
Figure 8:
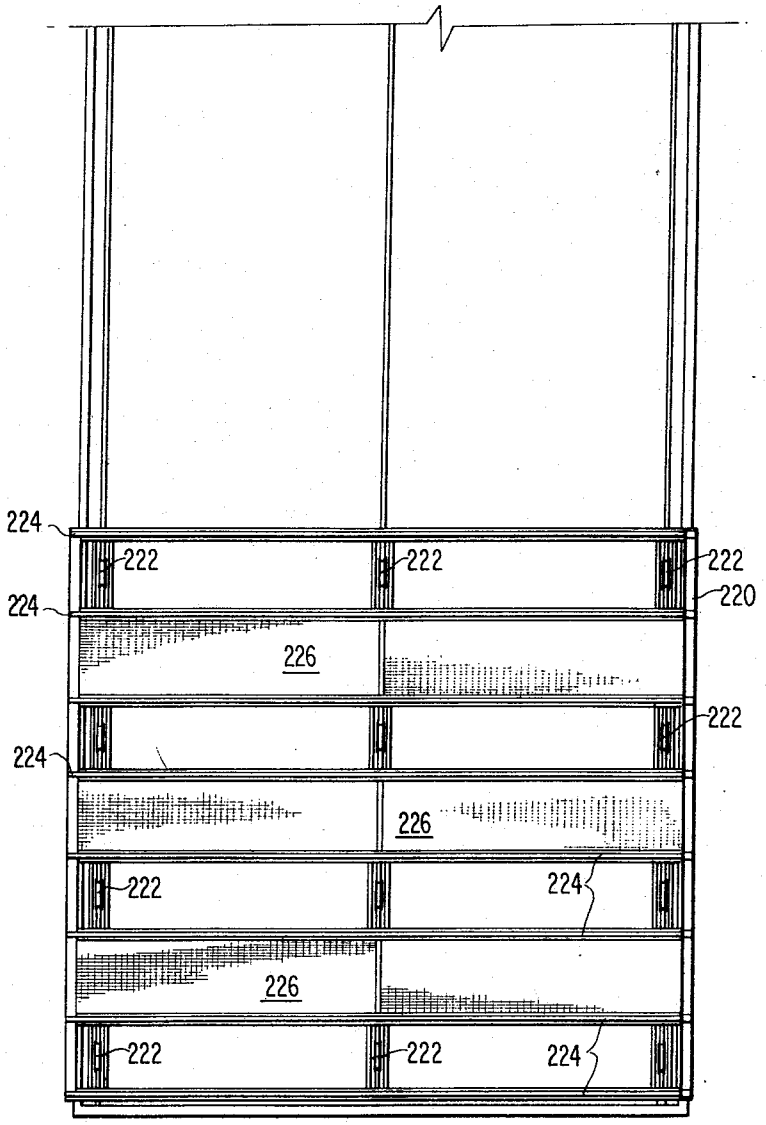
Figure 7:
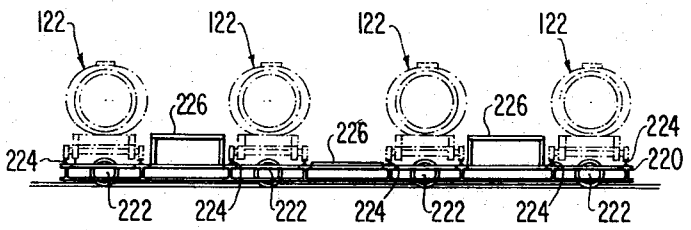
Figure 6:
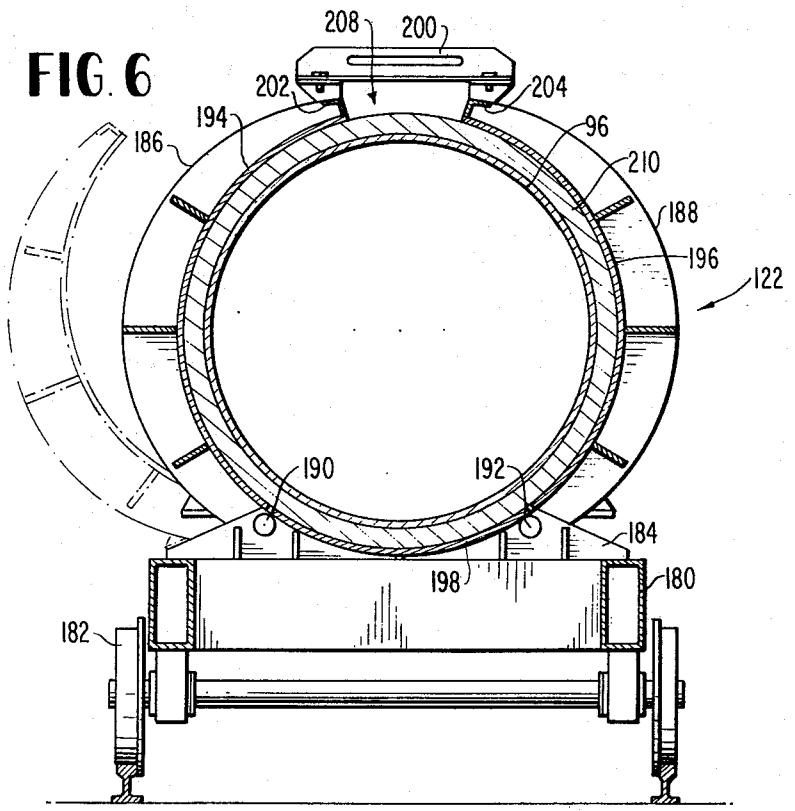
Figure 10:
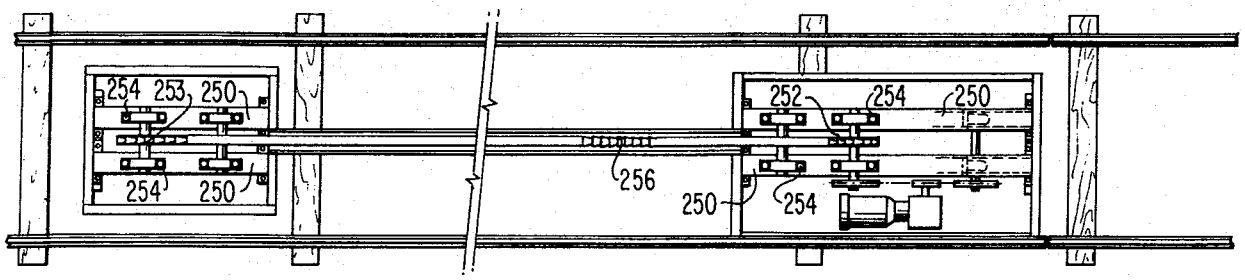
Figure 9:
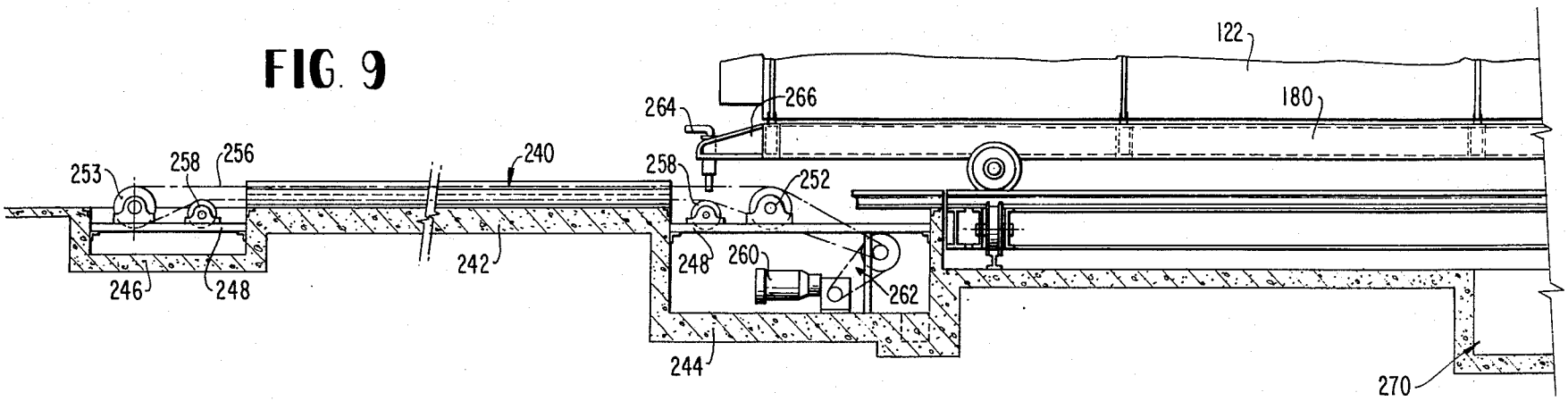

FIG. 5 comprises a side elevational view of a typical railway mold car of the type operably designed to form a cementitious weight coating upon the exterior surface of steel pipe segments;

FIG. 6 is a cross-sectional view taken along section line 6—6 in FIG. 5;

FIG. 7 is an end elevational view of a transfer car forming an aspect of the subject mold handling system;

FIG. 8 is a plan view of a railway system and transfer car assembly;

FIG. 9 is a cross-sectional detailed view of a power motive system utilized to translate the large and weighty mold cars upon railway systems; and FIG. 10 is a detail plan view of the motive system disclosed in FIG. 9.

DETAILED DESCRIPTION

Structural Details

Figure 1:
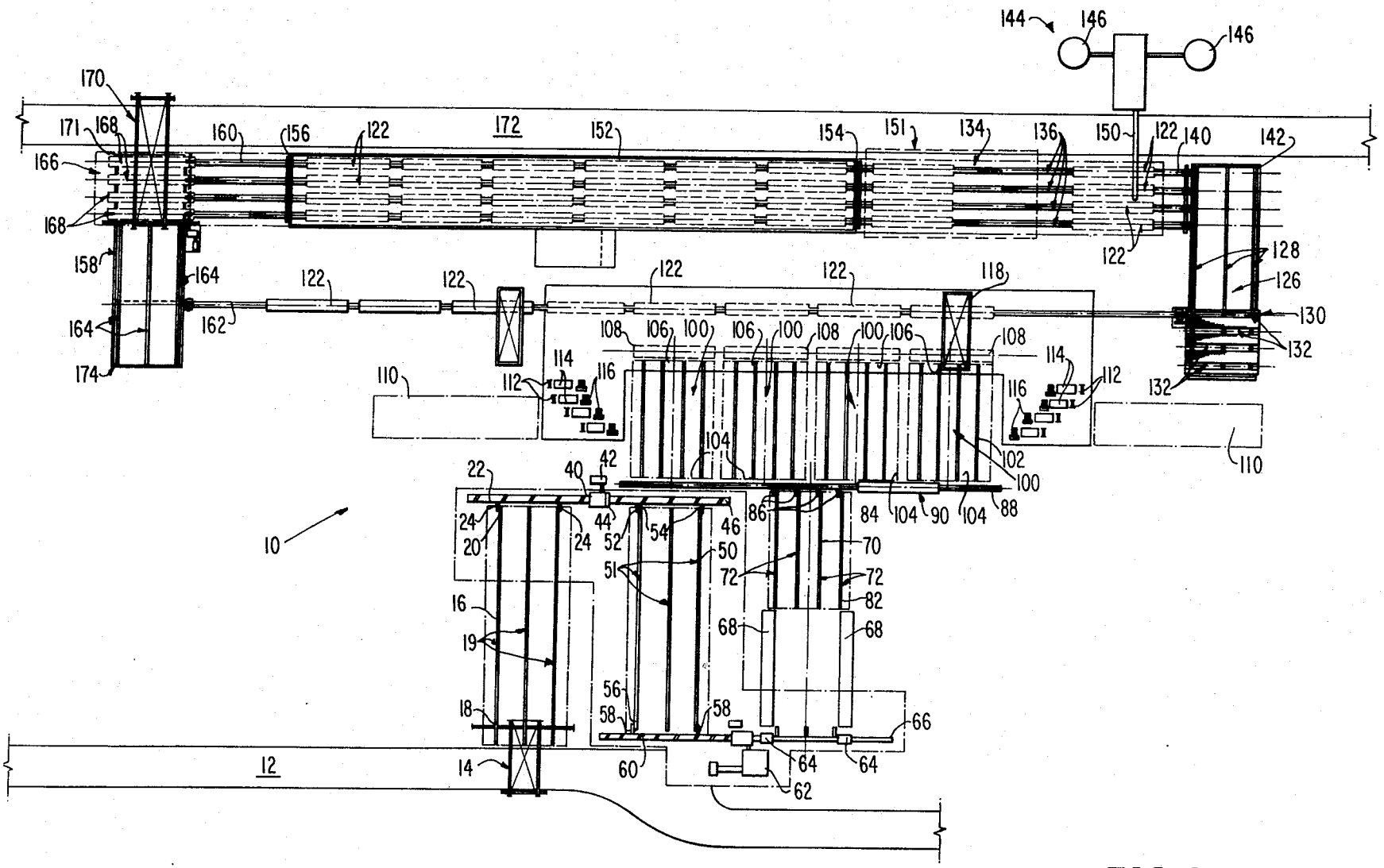
FIG. 1 is a plan view of a manufacturing facility for handling railway mold cars and molding a cementitious weight coating upon the exterior surface of steel pipe segments.

Referring now to the drawings and particularly to FIG. 1 thereof there will be seen a planned view of a pipe segment, weight coating plant 10 of the type which may be advantageously utilized to mold a weight coating to the exterior surface of steel pipe segments.

More particularly, the plant 10 is located adjacent to a roadway 12 operable to accommodate incoming vehicles carrying steel pipe segments to be weight coated. An overhead crane assembly 14 is positioned over the roadway 12 and is operable to extend to a pipe storage and transfer rack assembly 16. In this connection, a first end 18 of the pipe rack is positioned beneath one end of the crane assembly 14.

The rack 16 comprises a plurality of parallel pipe engaging rails 19 and slopes from the loading end 18 toward the opposite end 20 which ends in a posture adjacent to a normally extending skewed roller conveyor 22.

In order to transfer individual pipe segments onto the skewed roller conveyor 22, pipe kicker assemblies 24 are mounted at the discharge end 20 of the inclined rack 16.

Figure 2:
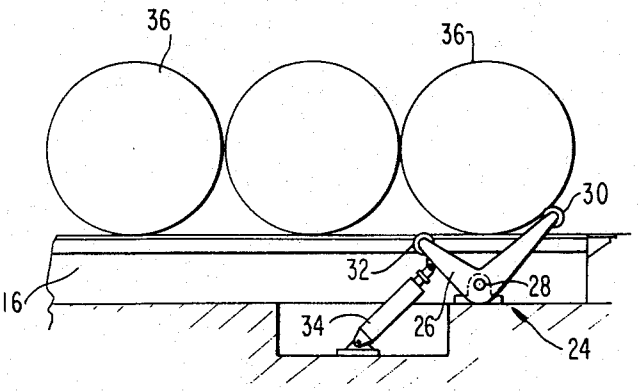
FIG. 2 is a detail view of a pipe "kicker" assembly operable to handle pipe segments as utilized in the manufacturing facility depicted in FIG. 1.

With reference now to FIG. 2, it will be seen that the kicker assemblies 24 each comprise a bell crank 26 pivoted at its elbow as at 28, and having roller assemblies 30 and 32 connected to the extremities thereof.

Selective actuation of the bell crank 26 is provided by a hydraulic piston and cylinder assembly 34 which is operable to extend and retract in a conventional manner.

As pipe segments 36 roll by gravity from left to right as viewed in FIG. 2 to the pipe kicker, the roller 30 stops movement onto the skewed conveyor 22. When it is desired, however, to load the conveyor 22, the piston within the piston and cylinder assembly 34 is actuated and the bell crank 26 swings upwardly about pivot 28 to push or "kick" the pipeline segment onto the skewed roller conveyor.

A shot blasting machine 40 is axially positioned with respect to the skewed conveyor 22 and is provided with a dust collector 42. An automatic priming device 44 is transversely positioned downstream from the shot blasting machine 40 and in advance of an outgoing skewed roller conveyor 46.

A storage and primer drying rack 50 is normally positioned with respect to the outgoing skewed roller conveyor 46 and parallel with respect to the incoming rack assembly 16. In a manner analagous to the incoming rack, the storage and drying rack 50 is fashioned with a plurality of parallel rails 51 and is provided at a first end 52 with pipe kicker assemblies 54, of a type similar to that previously described, in order to transfer the pipe segments from the conveyor 22 onto the rack 50.

The rack slopes from the loading end 52 down to the opposite end 56 where a second pair of pipe kicker transfer assemblies 58 are mounted. A skewed roller conveyor 60 is transversely positioned with respect to the drying rack 50 and functions to axially feed pipe segments into an automatic bituminous pipe coating and wrap machine 62.

A pair of outgoing pipe buggies 64 are mounted upon a track assembly 66 axially downstream from the automatic pipe coating and wrapping machine 62.

A pair of spaced cooling boards 68 having inwardly sloping surfaces are mounted transversely with respect to the rails 66. Axially aligned with the cooling boards 68 is a pipe storage rack 70 comprising a plurality of padded rails 72.

Figure 3:
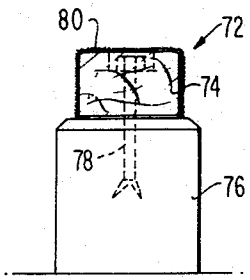
FIG. 3 is a detail cross-sectional view of a padded pipe storage rack as utilized in the manufacturing facility depicted in FIG. 1.

Turning specifically to FIG. 3, it will be seen that the padded rails 72 preferably comprise timber beams 74 which are mounted upon concrete pedestals 76 by threaded fasteners 78. The exterior surface of the timber beams 74 is covered with a padding material 80, such as carpet or the like.

Referring now again to FIG. 1, the padded pipe storage rack 70 slopes from a first end 82 downwardly to a second end 84. A plurality of pipe kicker assemblies 86 are mounted at the ends of rails 72.

Figure 4:
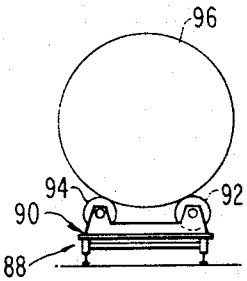
FIG. 4 is a detail cross-sectional view of a pipe shuttle car as utilized in the manufacturing facility depicted in FIG. 1.

Transversely positioned with respect to the rails 72 is a railway assembly 88 which serves to carry a shuttle car 90 (note FIG. 4). The shuttle car includes a plurality of lateral roller assemblies 92 and 94 which center coated and wrapped pipe segments 96.

The railway 88 extends along and normal to a plurality of normally extending padded pipe storage racks 100. Each of the storage racks 100 is comprised of a plurality of padded rail assemblies 102 of the type depicted in and previously specifically discussed in relation in FIG. 3. Each of the padded storage rack assemblies 100 slopes from a first end 104 adjacent the railway 88 down to a second end 106 which meets normally extending wire cage fabrication tables 108.

A coiled wire fabric storage area 110 is positioned on opposite sides of the storage racks 100 and adjacent to a plurality of wire fabric uncoilers 112, measuring tables 114 and straightening rollers 116.

A traveling overhead electric crane 118 spans the wire cage fabrication tables 108 and a first railway track means 120 operable to carry a plurality of individual weight coating mold cars 122 to be discussed in detail more fully hereinafter.

One end 124 of the first railway track assembly 120 is positioned adjacent to a second railway track assembly 126. The second railway track assembly 126 comprises a plurality of mutually parallel rails 128 which normally extend with respect to the first railway track assembly 120.

The second railway track assembly 126 serves to carry a first transfer car 130 which is designed with a plurality of pairs of rail segments 132 which are selectively alignable with the first railway track assembly 120.

Individual mold cars 122 may be transferred onto a railway segment 132 when the segments are brought into registry with the first railway track means. The transfer car may be loaded with a plurality of mold cars be sequentially advancing the transfer car to bring the railway segment 132 into alignment with the first track means 120.

A third railway track means 134 comprising a plurality of mutually parallel sets of railway rails 136 which extend at one end 140 normally with respect to the second railway track assembly 126.

The plurality of pairs of rail segments 132 mounted upon the first transfer car 130 are axially alignable at an unloading end 142 of the second railway track assembly with the plurality of rails 136.

A cementitious weight coating batch mixing plant 144 having individual mixing tanks 146 is positioned adjacent to the one end 140 of the third railway assembly. A conventional cementitious weight coating composition conveyor 150 extends over the one end 140 of the third railway assembly and is operably designed to deposit fluid cementitious weight coating material into a plurality of mold cars 122.

The mold cars 122 are then advanced on rails 136 to a preset area 15.

A longitudinally extending enclosed drying and curing kiln 152 is positioned around the third railway track assembly 134 downstream of the present area 151.

A plurality of pipe mold cars 122 are introduced abreast into the curing and drying kiln through an incoming counter balance vertical door 154. The cars are translated through the drying kiln 152 to an outgoing counter balance vertical door 156.

A fourth railway track assembly 158 is normally positioned with respect to and between the other ends 160 and 162 of the third and first railway track assemblies respectively.

The fourth railway track assembly 158 includes a plurality of rails 164 which serve to carry a second transfer car 166. The second transfer car includes a plurality of pairs of rail segments 168 which serve to carry a plurality of mold cars 122.

An overhead crane assembly 170 spans the second transfer car 166, at one end 171 of the fourth railway assembly 158, and a roadbed 172. Vehicles running on the roadbed may be utilized to receive pipe segments and transfer the weight coated pipe segments to a final curing and storage area.

The other end 174 of the fourth railway assembly 158 comprises a form cleaning and transfer area where the forms are cleaned, treated and axially guided onto the other end 162 of the first railway assembly 120 in a manner to be discussed in detail hereinafter.

Railway Mold Assembly

With reference now to FIGS. 5 and 6, there will be seen a side elevation and cross-sectional view of a rugged railway mold assembly 122 of the type suitable for use with the subject invention.

More particularly, the mold assembly 122 comprises a generally rectangular underframe 180 which is mounted upon a plurality of longitudinally spaced railway trucks 182. The railway trucks ride upon the previously discussed railway track means and serve to steadily guide controlled movement of the mold cars 122.

A plurality of mold base assemblies 184 extend transversely at longitudinally spaced regular intervals along the extent of the underframe 180 and function to support a first and second plurality of arcuate arms 186 and 188 respectively. The arcuate arms are pivotly connected at one of the ends thereof as at 190 and 192 to opposing portions of the base members 184 for pivotal movement to an open, note the phantom representation in FIG. 6, and a closed, note the solid representation in FIG. 6, posture about a pipe segment 96.

The first and second plurality of arcuate arms and the plurality of base members serve to support longitudinally extending arcuate forming shoes 194, 196 and 198 respectively. In order to maintain the forming surfaces 194–198 in a cylindrical configuration, a plurality of coupling handles 200 are mounted between the free ends 202 and 204 of the arcuate arms 186 and 188.

In order to support a pipe segment 96 to be weight coated concentrically within the generally cylindrical mold assembly, pillow blocks 206 are mounted on the ends of the frame 180 and are vertically dimensioned to provide the desired coaxial relationship between the pipe 96 and the interior surface of the cylindrical mold assembly.

It will be noted by reference to FIG. 6 that the longitudinally extending arcuate mold surfaces 194 and 196 do not completely close along the top surface of the mold assembly and therefore provide a longitudinally extending opening 208 for the reception of a fluid cementitious weight coating composition 210.

The foregoing discussed railway mold assembly does not per se form a part of the subject invention. For a more detailed discussion of railway mold assemblies particularly operable with the subject invention, reference may be had to applicants' previously noted copending application.

Transfer Car Assemblies

A transfer car assembly comprising the first and second transfer cars 130 and 166 respectively is specifically detailed in FIG. 7 and 8 of the drawings.

The transfer car includes a generally rectangular underfram 220 which is carried upon a plurality of flanged wheel assemblies 222. The wheel assemblies 222 in turn are directly supported upon the rails 128 or 164 of the first and second transfer car assemblies respectively. A plurality of pairs of rail segments 224 are mounted directly upon the upper surface of the frame 220 and extend in a posture transverse to the direction of intended travel of the transfer car and the rails 128 or 164 of the first and second transfer car assemblies respectively. Intercalated between adjacent pairs of rail segments 224 are planar working platforms 226 which may be fashioned from open grate metal work.

The rails 128 and 164 of the first and second transfer car assemblies respectively are mounted in a depression below the grade of the first and third railway assemblies 120 and 134. The depth of the depression is designed such that the top surfaces of the plurality of pairs of rail segments 224 are coplanar with the top surface of the rails of the first and third railway track assemblies 120 and 134. Therefore, railway mold cars may be loaded directly onto and off of the transfer car rail segment 224 from the rails from the first and third railway assemblies 120 and 134.

Mold Car and Transfer Car Motive Apparatus

Turning now specifically to FIGS. 9 and 10, there will be seen a motive system specifically designed to move the extremely weighty pipe segment mold cars 122 upon the first and third railway track means 120 and 134 and the first and second transfer car assemblies 130 and 166 upon the rails 128 and 164 respectively.

As viewed in FIG. 9, the motive system comprises an endless chain device 240. More particularly, the railway bed 242 is provided at the ends thereof with recesses 244 and 246 for the reception in each instance of a mounting frame 248 comprising parallel beams 250. Mounted upon the beams within recesses 244 and 246 are power and idler sprockets 252 and 253 respectively through the provision of bearing assemblies 254.

An endless open link chain, note FIG. 10, 256 is trained around the power and idler sprockets 252 and 253 and is properly tensioned by adjustable chain tensioner assemblies 258 mounted upon the bridge beams 250 inwardly of the sprockets.

In order to provide drive to the endless chain 256, a motor assembly 260 is mounted within the well 244 and is connected to the power sprocket 252 by a speed reducing pulley assembly 262.

One of the link chain drive assemblies is positioned beneath the rail means 120 and each of the parallel rails 136. Individual mold cars 122 are connected to the chain by the provision of vertically actuatable coupling pins 264 which extend through a tongue mounting 266 connected to the mold car frame 180 at each end thereof.

In order to translate the first and second transfer cars, an endless chain drive assembly is mounted within a well 270 centrally provided beneath the rails 128 and 164 respectively. The motor for the endless chain drive assemblies positioned with the transfer car wells is selected to be reversible so that the transfer car assemblies 130 and 166 may be moved back and forth in a mode of operation to be discussed in detail herein presently.

Operation

In performing the method according to a preferred embodiment of the invention, a plurality of steel pipe segments to be weight coated are delivered to the weight coating plant 10 along roadway 12. The delivery truck stops beneath overhead crane assembly 14 so that individual pipe segments may be lifted onto the inclined rack 16 and roll by gravity against the pipe kicker assembly 24.

The steel pipe segments 36 which typically are covered with rust and scale are transferred onto the skewed roller conveyor 22 and fed through the shot blasting machine 40 for cleaning. Following cleaning, the pipe is axially fed through a primer collar 44 and receives a thin coat of primer paint.

The primer coated pipe segments are then transferred onto the drying rack 50 and rolled by gravity down to the incoming skewed roller conveyor 60 for axial delivery through a bituminous coating and wrapping machine 62. The bituminous coating machine applies a thin, ⅛ to ¼ inch, hot coat of corrosion resistant bituminous composition which is immediately wrapped to maintain the coating upon the pipe segment.

The bituminous coating upon the pipe at this point in time is relatively soft and would readily deform if the pipe were placed directly upon conveying racks. The ends of the individual pipe segments, therefore, are left bare and are supported upon outgoing pipe buggies 64. The pipe buggies align the pipe between inwardly sloping cooling boards which merely contact the ends of the coated pipe segments. The sloping ends of the boards accommodate a variety of pipe lengths without contacting the coated surface.

After the bituminous coating has solidified, the coated and wrapped pipe segments are longitudinally transferred onto a padded storage rack 70 for selective delivery by pipe kicking assemblies 86 onto a shuttle car 90. The shuttle car 90 delivers the pipe segments onto one of four padded pipe storage racks 100.

The pipe segments are then individually transferred from the storage racks 100 onto reinforcing cage tables 108 where a circumferential sleeve of wire mesh reinforcing is applied to the exterior of the coated pipe segments.

The overhead crane 118 then lifts the pipe segments and the wire cage reinforcing above the individual mold car assemblies 122 and places the prepared pipe segments upon pillow blocks 206 at the ends of the mold cars.

The mold 122 is then securely closed and the towing pin 264 is engaged with the endless chain 256 to push the mold car 122 along the first railway track 120 and onto an aligned rail segment 132 of the first transfer car 130.

Once a first mold car 122 is positioned upon the transfer car 130, the transfer pit drag chain is selectively engaged to advance the car so that a second pair of rail segments 132 may be brought into axial registry with the first railway track 120. The sequence is repeated incrementally until the transfer car 130 is loaded with mold cars 122.

The entire transfer car 130 is then translated to the other end of the transfer pit and the plurality of pairs of rail segments 132 are brought into longitudinal registry with a like plurality of mutually parallel rails 136 comprising the third railway track assembly 134.

Coupling pins 264 are then engaged with endless chains 256 underlying eachof the parallel rails 136 to draw the molded segments 122 from the transfer car in an abreast posture adjacent a batch plant 144 for applying a fluid cementitious weight coating composition into the molds. In this connection, the cement conveying assembly 150 is manipulated longitudinally along the top opening 208 in the individual molds 122 to fill the annular void between the exterior surface of the pipeline segments 96 to be weight coated and the interior surfaces 194–198 of the mold assemblies. During this filling operation, the mold assemblies may be vibrated to assist in placement and distribution of the cementitious weight coating composition and eliminate the possibility of leaving cavities or voids within the final molded weight coating.

Once the molds are completely filled, the top opening 208 is sculptured to roundness by hand trowling or the like. The molds are then advanced into the preset area 151 and finally into a first end of the curing kiln 152.

The molds 122 are transferred abreast through the longitudinally extending drying kiln 152 at least until the cementitious material achieves a condition of being self-supporting. Depending upon the particular composition and water content of the cementitious material and the temperature and humidity of the kiln, this partial curing process may take as little as two or as much as six hours or more.

Upon suitable drying the mold cars 122 exit abreast from the counter balanced exit door 156 and are drawn up to the second transfer car 166. The coupling pin 264 at the other end of the mold car is then engaged with the respective individual endless chains and the mold cars and pushed abreast onto the second transfer car 166.

The molds are swung open and the overhead crane 170 picks the partially cured weight coated pipe segments vertically up and transfers them onto a truck bed provided with sand pile pillows or the like to delicately support the partially cured weight coating composition.

The pipe segments are then transferred to storage area for final curing and hardening of the weight coating composition.

Once the individual molds 122 are emptied, the transfer car 166 is engaged with the underlying endless chain 256 and the car is translated to the other end of the transfer pit. At this point, the molds are washed and cleaned and the rail segments 168 are sequentially aligned with the other end 162 of the first track means 120. The molds 122 are then transferred in axial end-to-end alignment onto the single track 120 and the process is repeated.

While the FIG. 1 discloses the transfer car as having four rail segments 132 and the third railway track assembly 134 as comprising four parallel sets of tracks, the exact number of this plurality of railway tracks may be varied depending upon the operating conditions of the plant design. The number of rail pairs is controlled by the length of curing time in the kiln and the amount of time necessary to provide a wire reinforcing cage about the pipe segments to be weight coated. In this connection, in order to economically utilize the extremely larege and weighty mold assemblies, it is necessary that a continuous operation be provided. Therefore, the more rapid process of applying a wire cage with respect to the time span in the drying kiln is correlated and the number of parallel sets of rails 136 is selected so that a continuous closed loop system may be achieved.

SUMMARY OF THE MAJOR ADVANTAGES OF THE INVENTION

It will be appreciated that the foregoing method and apparatus provides a highly desirable continuous closed loop, mechanized system for molding a cementitious weight coating to the exterior surface of pipe segments. The extremely large and weighty mold car assemblies are effectively and reliably handled in a continuous closed loop system in a mechanized manner which essentially eliminates laborious manual techniques.

By the provision and arrangement of unitary and multiple railway track assemblies, a closed loop system is provided which is highly efficient and optimizes the utilization of mold car assemblies which are maintained essentially in perpetual motion.

A further highly significant advantage of the present invention is the provision of a method and apparatus for efficiently handling and preparing individual pipe segments to be weight coated by cleaning, priming, coating with a bituminous coat and providing a wire cage reinforcing prior to the molding operation.

While the invention has been described with reference to preferred embodiments, it will be appreciated by those skilled in the art that additions, deletions, modifications and substitutions, or other changes not specifically described may be made which will fall within the perview of the appended claims.

What is claimed is:

1. A method for continuously handling railway mold cars and molding a weight coating onto the exterior surface of pipe segments comprising the steps of:

providing first railway track means adjacent a pipe coating location;

coating a plurality of pipe segments to be weight coated with a corrosion resistant composition at said pipe coating location;

storing said coated pipe segments adjacent said first railway track means while said coating hardens;

positioning individual, coated pipe segments to be weight coated into individual mold cars positioned end-to-end upon said first railway track means comprising a unitary pair of rails, the mold cars being compatably dimensional with respect to the pipe segments so as to form voids between an exterior surface of the pipe segments and an interior surface of the mold cars;

translating from one end of the first railway track means a plurality of the individual mold cars and the contained pipe segments onto a first transfer car having a plurality of pairs of rail segments for supporting the plurality of individual mold cars, said translating including positioning a first pair of rail segments of the first transfer car into longitudinal registry with the one end of the first railway track means, moving one of the individual mold cars onto the first pair of rail segments of the first transfer car, positioning at least a second pair of rail segments of the first transfer car into longitudinal registry with the one end of the first railway track means, and moving at least another one of the individual mold cars onto at least a second pair of rail segments of the first transfer car;

transporting said first transfer car, including a plurality of individual mold cars and the pipe segments contained thereon which have been translated onto said first transfer car, upon a second railway track means extending transversely with respect to the first railway track means toward one end of a third railway track means comprising a plurality of pairs of mutually parallel sets of rails, said third railway track means extending longitudinally with respect to said first railway track means and transversely with respect to said second railway track means;

simultaneously aligning the pairs of rail segments of said first transfer car with respective pairs of rails of said third railway track means;

translating a plurality of individual mold cars and pipe segments contained thereon from said first transfer car and onto said one end of said third railway track means so that said mold cars are disposed abreast of one another on respective pairs of rails of said third track means;

filling said voids between the exterior surfaces on the individual pipeline segments and the interior surfaces of said mold cars with a weight coating composition in a fluid state;

said filling of said voids being effected while said plurality of mold cars are disposed abreast at a void filling location on said third track means, with each mold car being separately operable to receive said weight coating composition;

transporting abreast upon said third railway track means, said plurality of individual mold cars into a curing kiln;

at least partially curing said weight coating composition within said curing kiln until the composition is at least self-supporting upon the exterior surfaces of said pipe segments;

translating abreast a plurality of individual mold cars out of said curing kiln and onto parallel pairs of rails carried by a second transfer car positioned at another end of said third railway means, with said parallel pairs of rails of said second transfer car being simultaneously aligned with said plurality of pairs of rails of said third railway track means;

opening said mold cars and removing the weight coated pipe segments therefrom so as to empty said mold cars;

said removing of said weight coated pipe segments being effected while said plurality of mold cars are disposed abreast, with each said mold cars being independently operable to permit said removal of a weight coated pipe segment;

simultaneously transferring said second transfer car and a plurality of empty mold cars mounted abreast thereupon along a fourth railway track means toward said first railway track means, with said fourth railway track means extending transversely with respect to the first and third railway track means;

cleaning said plurality of mold cars while said plurality of mold cars are disposed abreast in said fourth railway track means;

sequentially bringing said parallel pairs of rails of said second car into alignment with another end of the first railway track means; and sequentially moving said empty mold cars into end-to-end relation on said first railway track means with said mold cars being then operable to receive further pipe segments to be weight coated.

* * * * *